United States Patent [19]

Davis

[11] Patent Number: 4,601,365

[45] Date of Patent: Jul. 22, 1986

[54] RAIN GUTTER LADDER SUPPORT

[76] Inventor: Curtis E. Davis, 1462 E. Tamassee Dr., Seneca, S.C. 29678

[21] Appl. No.: 742,972

[22] Filed: Jun. 10, 1985

[51] Int. Cl.[4] ..... E04D 13/04; E06C 7/48; E04G 21/24

[52] U.S. Cl. ..... 182/230; 182/107; 182/214; 248/210; 52/11

[58] Field of Search ..... 182/214, 206, 108, 107; 52/11, 12, 13, 14, 15

[56] References Cited

U.S. PATENT DOCUMENTS 4,185,421 1/1980 Robinson ..... 52/11
4,272,370 6/1981 Cunning ..... 52/12

FOREIGN PATENT DOCUMENTS 493868 2/1978 Australia ..... 182/214

*Primary Examiner*—Reinaldo P. Machado
*Attorney, Agent, or Firm*—Cort Flint

[57] ABSTRACT

A rain gutter ladder support device (A) is illustrated which may be placed inside of a gutter (12). The device is designed to fit snuggly inside the gutter with a front bar (10) engaged against the front edge (12*a*) of the gutter (12). The device reinforces the front edge (12*a*) of the gutter when a ladder (L) is placed against the front edge (12*a*) to fully support the ladder and weight of the person without damaging the gutter. The device may be made of various metals and can be made in various sizes to fit different size gutters.

4 Claims, 4 Drawing Figures

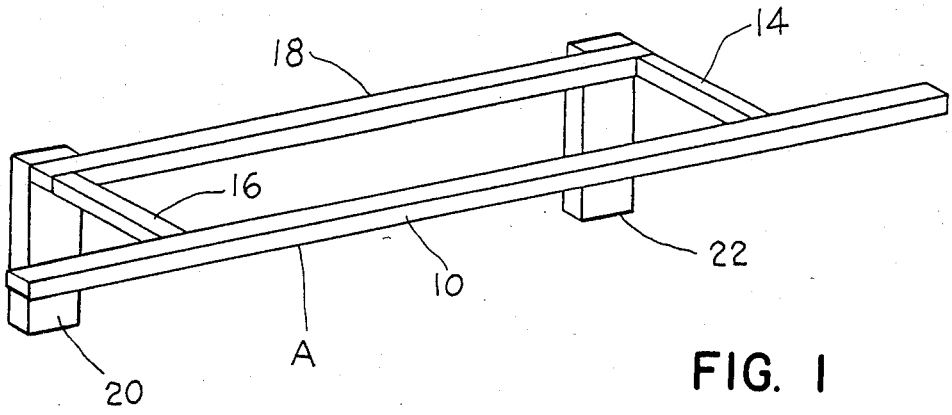
FIG. 1
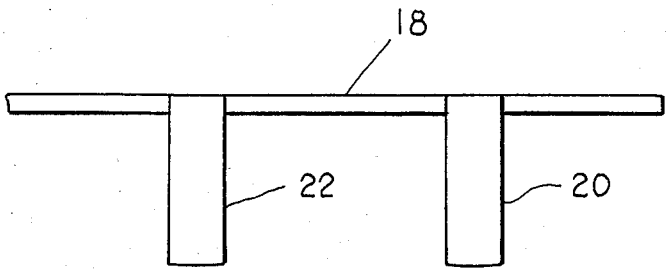
FIG. 2
FIG. 3
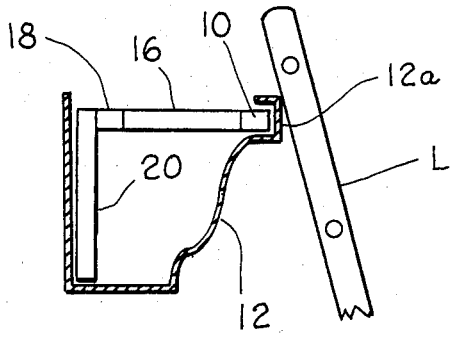
FIG. 4
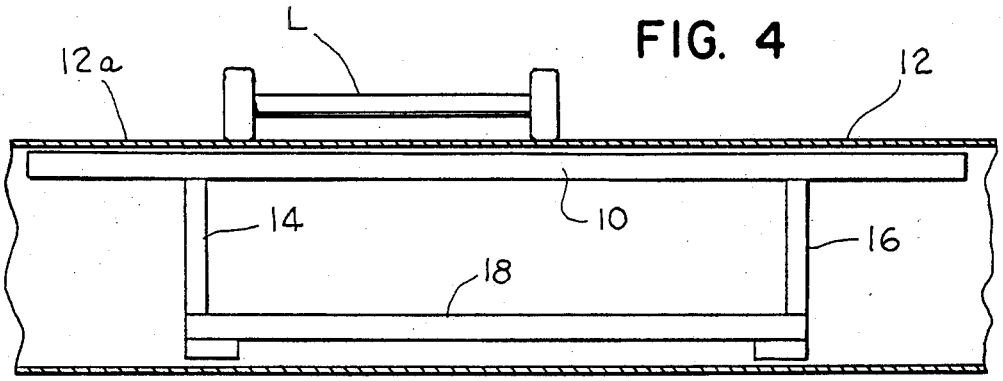

RAIN GUTTER LADDER SUPPORT

BACKGROUND OF THE INVENTION

The invention relates to a device which may be placed within a rain gutter to reinforce and stabilize the rain gutter when a ladder is supported against the rain gutter.

SUMMARY OF THE INVENTION

The rain gutter ladder support device is preferably made of metal and designed to be placed inside of a rain gutter attached to the eave of houses and buildings. The rain gutter ladder support device is designed to be inserted inside the gutter, reinforcing the gutter to keep it from bending or getting damaged when a ladder is placed against the gutter. The various parts of the rain gutter ladder support device can be assembled by welding, bolting, or other conventional assembly techniques. Various sizes of the ladder support devices can be produced to fit the various size gutters.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view illustrating a rain gutter ladder support device constructed according to the present invention;

FIG. 2 is a rear elevation illustrating a rain gutter ladder support device constructed according to the invention;

FIG. 3 is an end view of the rain gutter ladder support device inserted within a gutter, with the gutter being sectioned; and FIG. 4 is a top plan view of a rain gutter ladder support device constructed in accordance with the present invention.

DESCRIPTION OF A PREFERRED EMBODIMENT

Referring now in more detail to the drawings, FIG. 1 illustrates a rain gutter ladder support device A which includes an elongated front bar 10 which rests inside the outer edge of a gutter 12 when inserted within the gutter. In the case of most conventional gutters, this edge against which bar 10 rests includes a lip 12*a*. Front bar 10 is braced by a pair of brace arms 14 and 16 which extend from a rear bar 18. Rear bar 18 is supported by a pair of vertical legs 20 and 22. Rear legs 20 and 22 rest in the bottom of the rear of gutter 12 to support and maintain the device A in a stable and gutter-supporting position with a ladder L leaned against edge 12*a* of gutter 12.

As can best be seen in FIG. 3, the rear legs rest on the bottom of gutter 12 to stabilize and support gutter 12 against ladder L.

The elongated front support bar 10 rests inside the front edge or lip 12*a* of gutter 12 in a manner that device A is braced between the rear vertical wall of gutter 12 and front edge 12*a* of gutter 12 to effectively support ladder L without bending or damage to the gutter. Rear bar 18 rests against the rear top of the gutter which is attached to the facing board of the house or building.

Thus it can be seen that an advantageous construction for a rain gutter ladder support device can be had in accordance with the invention which will protect a gutter from damage when a ladder or climbing device is placed against the gutter, but reinforcing a front edge of the gutter. The ladder support device stabilizes itself by two rear legs which press against the rear bottom of the gutter when the ladder weight is applied to the front edge. The rain gutter ladder support allows water and debris to continue to flow in the gutter while it may remain installed in the gutter. The rain gutter ladder support device does not change the appearance of the gutter because it is always completely hidden inside the gutter. The device is self-supporting and requires no permanent fastener to hold it in place, and can be left in the gutter when not in use, or easily removed for cleaning by lifting up on the rear horizontal bar of the device.

While a preferred embodiment of the invention has been described using specific terms, such description is for illustrative purposes only, and it is to be understood that changes and variations may be made without departing from the spirit or scope of the following claims.

I claim:

1. A rain gutter ladder support device comprising a front support bar for engaging a front edge of said gutter; horizontal arm means for bracing said front support bar between said front edge of said gutter and a rear wall of said gutter; vertical leg means for resting against a rear bottom portion of said gutter and supporting said horizontal arm means above said bottom of said gutter in a manner that said front support bar is braced against said front edge of said gutter to stabilize and fully support the weight of a ladder and person on the ladder leaning against said front edge of said gutter.

2. The device of claim 1 wherein said vertical leg means comprises a pair of spaced vertical legs and said device further includes a rear bar bridging said pair of legs.

3. The device of claim 1 wherein said horizontal arm means includes at least a pair of horizontal arms extending outwardly from said vertical legs and rear support bar of said device, said at least two horizontal arms supporting said front support bar.

4. The device of claim 3 wherein said horizontal arms and front support bar are carried in a canterlevered manner by said rear vertical legs in a manner that said device allows water and debris to continue to flow through said gutter while said ladder support device is installed in said gutter.

* * * * *